US008218980B2

(12) United States Patent
Koie

(10) Patent No.: US 8,218,980 B2
(45) Date of Patent: Jul. 10, 2012

(54) IMAGE FORMING DEVICE

(75) Inventor: Hiroshi Koie, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 982 days.

(21) Appl. No.: 11/959,985

(22) Filed: Dec. 19, 2007

(65) Prior Publication Data

US 2008/0152364 A1 Jun. 26, 2008

(30) Foreign Application Priority Data

Dec. 26, 2006 (JP) ..... 2006-349700

(51) Int. Cl.
*G03G 15/00* (2006.01)

(52) U.S. Cl. ..... 399/12

(58) Field of Classification Search ..... 399/12
See application file for complete search history.

(56) References Cited

U.S. PATENT DOCUMENTS

| | | | | |
|---|---|---|---|---|
| 6,158,837 | A * | 12/2000 | Hilton et al. | 347/19 |
| 6,549,732 | B2 * | 4/2003 | Yoshizaki et al. | 399/12 |
| 6,711,362 | B2 * | 3/2004 | Asakura | 399/12 |
| 7,136,598 | B2 * | 11/2006 | Suzuki | 399/12 |
| 7,139,494 | B2 * | 11/2006 | Ono et al. | 399/12 |
| 7,206,524 | B2 | 4/2007 | Yokoe | |
| 7,263,298 | B2 * | 8/2007 | Nagamine et al. | 399/12 |
| 7,725,044 | B2 * | 5/2010 | Kim | 399/12 |
| 2002/0157047 | A1 * | 10/2002 | Hosokawa | 714/718 |
| 2005/0078969 | A1 * | 4/2005 | Kikuchi | 399/12 |
| 2005/0244169 | A1 * | 11/2005 | Ono | 399/12 |
| 2005/0254835 | A1 * | 11/2005 | Takei | 399/12 |
| 2005/0254836 | A1 * | 11/2005 | Takei | 399/12 |
| 2006/0051106 | A1 * | 3/2006 | Takahashi et al. | 399/12 |
| 2011/0158659 | A1 * | 6/2011 | Tarao | 399/8 |
| 2011/0217051 | A1 * | 9/2011 | Takahashi | 399/12 |
| 2011/0229154 | A1 * | 9/2011 | Kim et al. | 399/12 |

FOREIGN PATENT DOCUMENTS

| | | |
|---|---|---|
| JP | 2005-326731 | 11/2005 |
| JP | 2006-215441 | 8/2006 |

* cited by examiner

*Primary Examiner* — David Gray
*Assistant Examiner* — Geoffrey Evans
(74) *Attorney, Agent, or Firm* — Banner & Witcoff, Ltd.

(57) ABSTRACT

An image forming device includes a main body, a replaceable unit, a determination unit, a first memory, a second memory, a temporary memory, a first control unit, and a second control unit. The determination unit determines whether the replaceable unit is a genuine product or a non-genuine product with respect to the main body. The first memory is configured to store a physical value increasing with a use of the main body mounted with the genuine product. The second memory is configured to store the physical value increasing with the use of the main body mounted with the non-genuine product. The temporary memory is configured to temporarily store the physical value increasing with the use of the main body mounted with the non-genuine product.

6 Claims, 8 Drawing Sheets

IMAGE FORMING DEVICE

CROSS REFERENCE TO RELATED APPLICATION

The present application claims priority from Japanese patent application No. 2006-349700, which was filed on Dec. 26, 2006, the disclosure of which is herein incorporated by reference in its entirety.

TECHNICAL FIELD

The present invention relates to an image forming apparatus such as a laser printer.

BACKGROUND

A consumable supply such as a toner cartridge is mounted in an image forming device so as to be replaced by a user as a replaceable unit. Specifically, when the toner cartridge reaches the end of its usefulness as the replaceable unit (for example, when the level of toner contained in the toner cartridge is equal to or below a predetermined level), the user takes the toner cartridge out of a main casing of the image forming device, and then mounts a new toner cartridge in the main casing.

There is known an image forming device which determines whether or not a replaceable unit is a genuine product with respect to the image forming device, provided that the replaceable unit has been mounted in the main casing. Japanese Patent Application Publication No. 2005-326731 discloses an image forming device which includes a memory chip in a main casing. In this configuration, the memory chip can wireless-communicate with a replaceable unit. The contents stored in the memory chip are read by a wireless communication unit provided in the main casing via wireless communication. Based on the readout contents, the image forming device determines whether or not the replaceable unit mounted in the main casing is a genuine product.

SUMMARY

In the above-described conventional configuration, however, the contents stored in the memory chip are sometimes read incorrectly due to noise. In this case, the image forming device determines that the replaceable unit mounted in the main casing is not the genuine product (or equivalently, that the replaceable unit is a non-genuine product) by mistake, even when the replaceable unit is the genuine product. In addition, if a connection is bad between the memory chip and the wireless communication unit via a connector, the memory chip contents are also read incorrectly, thereby causing the same error in the determination.

Usage histories for both the genuine and non-genuine products, which are replaceable units, may be stored in a memory included in the main casing. Then, in the case of device trouble, the trouble may be identified based on the stored usage histories for both the genuine and non-genuine products. However, once a wrong determination has been made that the mounted replaceable unit is the non-genuine product, correct usage histories for both the genuine and non-genuine products cannot be stored in a memory.

In view of the foregoing, it is an object of the present invention to provide an image forming device capable of correctly storing usage histories (physical value increasing with the use of the image forming device) for both genuine and non-genuine replaceable units in a memory.

In order to attain the above and other objects, the invention provides an image forming device including a main body, a replaceable unit, a determination unit, a first memory, a second memory, a temporary memory, a first control unit, and a second control unit. The replaceable unit is detachably mounted in the main body. The determination unit determines whether the replaceable unit is a genuine product or a non-genuine product with respect to the main body. The first memory is configured to store a physical value changing with a use of the main body mounted with the genuine product. The second memory is configured to store the physical value changing with the use of the main body mounted with the non-genuine product. The temporary memory is configured to temporarily store the physical value changing with the use of the main body mounted with the non-genuine product. The first control unit counts the physical value on the first memory, if the determination unit determines that the replaceable unit mounted on the main body is the genuine product. The second control unit counts the physical value stored on the temporary memory if the determination unit determines that the replaceable unit mounted on the main body is the non-genuine product and stores the physical value stored in the temporary memory onto the second memory if the physical value in the temporary memory reaches a predetermined value.

According to another aspect, the invention also provides an image forming device capable of forming image on a recording medium. The image forming device includes, a main body, a replaceable unit, a determination unit, a jam detection unit, a jam memory, a first memory, a second memory, a temporary memory, a first control unit, and a second control unit. The replaceable unit is detachably mounted in the main body. The determination unit determines whether the replaceable unit is a genuine product or a non-genuine product with respect to the main body. The jam detection unit detects an occurrence of jam of the recording medium. The jam memory stores the number of occurrences of jam detected by the jam detection unit. The first memory is configured to store a physical value changing with a use of the main body mounted with the genuine product. The second memory is configured to store the physical value changing with the use of the main body mounted with the non-genuine product. The temporary memory is configured to temporarily store the physical value changing with the use of the main body mounted with the non-genuine product. The first control unit counts the physical value on the first memory, if the determination unit determines that the replaceable unit mounted on the main body is the genuine product. The second control unit counts the physical value stored on the temporary memory if the determination unit determines that the replaceable unit mounted on the main body is the non-genuine product, and stores the physical value stored in the temporary memory onto the second memory if the number of the occurrences of jam in the jam memory reaches a predetermined value.

DETAILED DESCRIPTION

Figure 1:
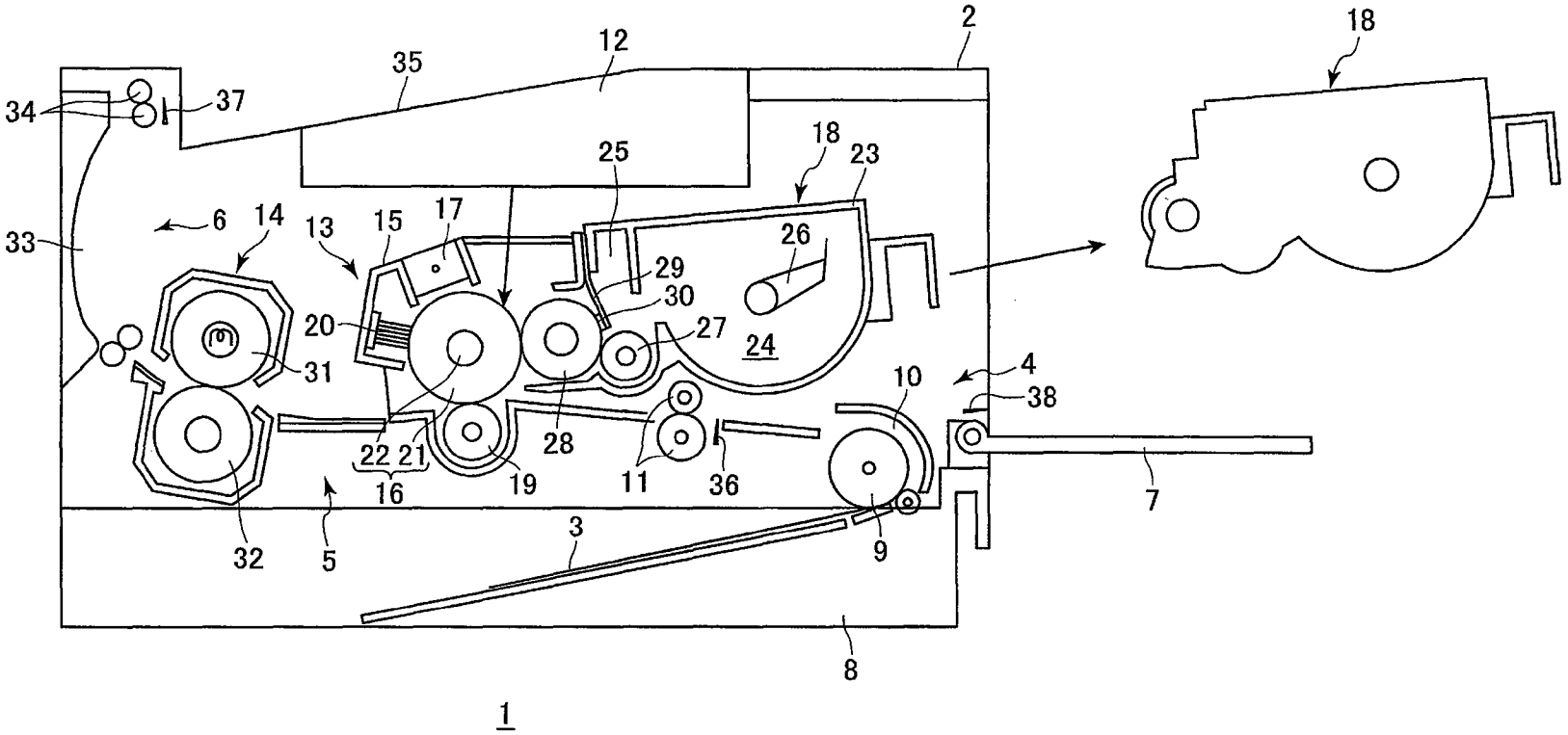
FIG. 1 is a side cross-sectional view schematically showing a structure of a laser printer according to an embodiment of the present invention.

An image forming device according to preferred embodiments of the present invention will be described while referring to the accompanying drawings wherein like parts and components are designated by the same reference numerals to avoid duplicating description.

1. General Structure of a Laser Printer

FIG. 1 is a side cross-sectional view of a laser printer 1 serving as the image-forming device of the present invention. The laser printer 1 includes a main casing 2 and, within the main casing 2, a feeder unit 4 for supplying sheets of a paper 3, an image-forming unit 5 for forming image on the paper 3 supplied from the feeder unit 4, and a discharge unit 6 for discharging the paper 3 on which the image is formed.

(1) Main Casing

An access opening is formed in one side surface of the main casing 2 for inserting and removing a developer cartridge 18 described later. A front cover 7 is disposed on the side surface of the main casing 2 and is capable of opening and closing over the access opening. In the following description, the side of the laser printer 1 on which the front cover 7 is provided will be referred to as the "front side," while the opposite side will be referred to as the "rear side."

(2) Feeder Unit

The feeder unit 4 includes a paper tray 8 for accommodating stacked sheets of the paper 3. The paper tray 8 is detachably mounted in a lower section of the main casing 2. A feeding roller 9 is disposed above a front end of the paper tray 8. Rotation of the feeding roller 9 feeds the paper 3 stacked in the paper tray 8 one sheet at a time toward a paper-feeding path 10. The paper 3 is fed toward the image-forming unit 5 (between a photosensitive drum 16 and a transfer roller 19 described later) after the paper 3 passes through the paper-feeding path 10 and is adjusted by registration rollers 11.

(3) Image-Forming Unit

The image-forming unit 5 includes a scanning unit 12, a processing unit 13, and a fixing unit 14.

(3-1) Scanning Unit

The scanning unit 12 is disposed in the upper section of the main casing 2 and includes a laser light source, mirrors, and lenses. The scanning unit 12 emits a laser beam to the photosensitive drum 16.

(3-2) Process Cartridge

The processing unit 13 is detachably mounted in the main casing 2 beneath the scanning unit 12. The process unit 13 includes a processing frame 15, the developer cartridge 18 and, within the processing frame 15, the photosensitive drum 16, a Scorotron charger 17, the transfer roller 19, and a cleaning brush 20.

The photosensitive drum 16 includes a main drum body 21 that is cylindrical in shape, and a drum shaft 22 extending along an axial center of the main drum body 21 in the longitudinal direction thereof. The main drum body 21 is rotatably supported about the drum shaft 22. The drum shaft 22 is fixed on side plates of the processing frame 15, the side plates being located both ends of the processing frame 15 in a direction perpendicular to the front-to-rear direction, so that the photosensitive drum 16 can rotate in the processing frame 15 about the drum shaft 22. During an image-forming process, the photosensitive drum 16 is driven to rotate by a driving force of a motor (not shown).

The Scorotron charger 17 is disposed diagonally above and rearward of the photosensitive drum 16 in opposition to but separated a prescribed distance from the photosensitive drum 16 so as not to contact the same. The Scorotron charger 17 can form a uniform charge of positive polarity over the surface of the photosensitive drum 16.

The transfer roller 19 is disposed below the photosensitive drum 16 and contacts the lower side of the photosensitive drum 16. The transfer roller 19 is configured of a metal transfer roller shaft and a rubber roller formed of an electrically conductive rubber material that covers the transfer roller shaft. The transfer roller shaft of the transfer roller 19 is rotatably supported on the processing frame 15. During the image-forming operation, the transfer roller 19 is driven to rotate by a motor (not shown) provided in the main casing 2 while a predetermined transfer bias is applied to the transfer roller 19.

The cleaning brush 20 is disposed rearward of the photosensitive drum 16 and supported on the processing frame 15 so that a tip of the brush is in contact with the photosensitive drum 16.

The developer cartridge 18 includes a developer casing 23. The developer casing 23 is formed in a box shape having an opening formed in the rear side thereof. A partitioning wall is provided in the developer casing 23 for partitioning the interior of the developer casing 23 into a toner-accommodating chamber 24, and a developing chamber 25.

The toner-accommodating chamber 24 is filled with a non-magnetic, single-component toner having a positive charge. An agitator 26 is provided in the toner-accommodating chamber 24 for stir the toner. While agitating toner in the toner-accommodating chamber 24, the agitator 26 discharges some of the toner from the toner-accommodating chamber 26 toward the developing chamber 25.

The developer cartridge 18 further includes a supply roller 27, a developing roller 28, and a thickness-regulating blade 29 within the developing chamber 25.

The supply roller 27 is disposed rearward of a boundary between the toner-accommodating chamber 24 and the developer chamber 25. The supply roller 27 includes a metal supply roller shaft and a sponge roller formed of an electrically conductive foam material that covers the supply roller shaft. The supply roller shaft is rotatably supported on both side plates of the developer casing 23. During the image-forming operation, the supply roller 27 is driven to rotate by a motor (not shown) provided in the main casing 2

The developing roller 28 is disposed rearward of the supply roller 27 and contacts the supply roller 27 with pressure. The developing roller 28 contacts the photosensitive drum 16 from diagonally above and forward thereof while the developer cartridge 18 is mounted on the processing frame 15. The developing roller 28 includes a metal developing roller shaft, and a rubber roller formed of an electrically conductive rubber material that covers the developing roller shaft. The developing roller shaft is rotatably supported in the developing chamber 25 in both side walls of the developer casing 23. During the image-forming operation, the developing roller 28 is driven to rotate by a motor (not shown) provided in the main casing 2 while a predetermined developing bias is applied to the developing roller 28.

The thickness-regulating blade 29 includes a metal leaf spring member, and a pressing member 30 provided on a free end of the leaf spring member. The pressing member 30 is formed of an insulating silicon rubber. A fixed end of the main blade member is attached to the developer casing 23 above the developing roller 28. The elastic force of the leaf spring member causes the pressing member 30 to contact the surface of the developing roller 28 with pressure from diagonally above and forward of the developing roller 28.

Toner discharged from the toner-accommodating chamber 24 to the developing chamber 25 is supplied onto the developing roller 28 by the rotating supply roller 27. At this time, the toner is positively tribocharged between the developing roller 28 and the supply roller 27. As the developing roller 28 rotates, toner passes between the developing roller 28 and the pressing member 30 of the thickness-regulating blade 29, thereby maintaining a uniform thickness of toner on the developing roller 28.

In the meantime, the Scorotron charger 17 charges a photosensitive layer of the surface of the photosensitive drum 16 with a uniform positive polarity. Subsequently, the scanning unit 12 irradiates a laser beam onto the charged photosensitive layer of the photosensitive drum 16 in a high speed scan to form an electrostatic latent image on the photosensitive drum 16 based on image data.

Next, positively charged toner carried on the surface of the developing roller 28 comes into contact with the photosensitive drum 16 as the developing roller 28 rotates and is supplied to areas on the surface of the positively charged photosensitive drum 16 that were exposed to the laser beam and, therefore, have a lower potential. In this way, the latent image on the photosensitive drum 16 is transformed into a visible image according to a reverse development process so that a toner image is carried on the surface of the photosensitive drum 16.

As the registration rollers 11 convey a sheet of the paper 3 through a transfer position between the photosensitive drum 16 and transfer roller 19, the toner image carried on the surface of the photosensitive drum 16 is transferred onto the paper 3 by a transfer bias applied to the paper 3. Subsequently, the paper 3 onto which the toner image is transferred is fed to the fixing unit 19.

Toner remaining on the surface of the photosensitive drum 16 after the transfer operation is recovered by the developing roller 28. Further, paper dust deposited on the photosensitive drum 16 from the paper 3 is removed from the surface of the photosensitive drum 16 by the cleaning brush 20.

(3-3) Fixing Unit

The fixing unit 19 is disposed rearward of the processing unit 18 and includes a heating roller 31 and a pressure roller 32. The pressure roller 32 is disposed below and in opposition to the heating roller 31 and contacts the heating roller 31 with pressure. In the fixing unit 19, toner transferred onto the paper 3 is fixed to the paper 3 by heat and pressure as the paper 3 passes between the heating roller 31 and pressure roller 32.

(4) Discharge Unit

The discharge unit 6 includes a paper discharge path 33 having a C-shape in cross-section that extends from the fixing unit 14 toward the top surface of the main casing 2. Paper discharge rollers 34 are provided at the top end of the paper discharge path 33. After the fixing process, the paper 3 is conveyed along the paper discharge path 33 and the paper discharge rollers 34 discharge the paper 3 onto a paper discharge tray 35 formed on the top surface of the main casing 2.

(5) Sensor

The laser printer 1 further includes a registration sensor 36, a paper discharge sensor 37, and a cover sensor 38.

The registration sensor 36 is provided near the registration rollers 11. The registration sensor 36 outputs a signal for indicating whether the presence or absence of the paper 3 at a position where the registration sensor 36 is disposed. The paper discharge sensor 37 is provided near the paper discharge rollers 34. The paper discharge sensor 37 outputs a signal for indicating whether the presence or absence of the paper 3 at a position where the paper discharge sensor 37 is disposed. The cover sensor 38 is provided near the front cover 7 when the front cover 7 is in a closed state. The cover sensor 38 outputs a signal for indicating whether the front cover 7 is in an open state or in a closed state.

Each of the registration sensor 36, the paper discharge sensor 37, and the cover sensor 38 may be a contact sensor (switch) having an actuator, or a noncontact sensor such as an optical sensor and a capacitance sensor.

2. Electrical Configuration of the Laser Printer

Figure 2:
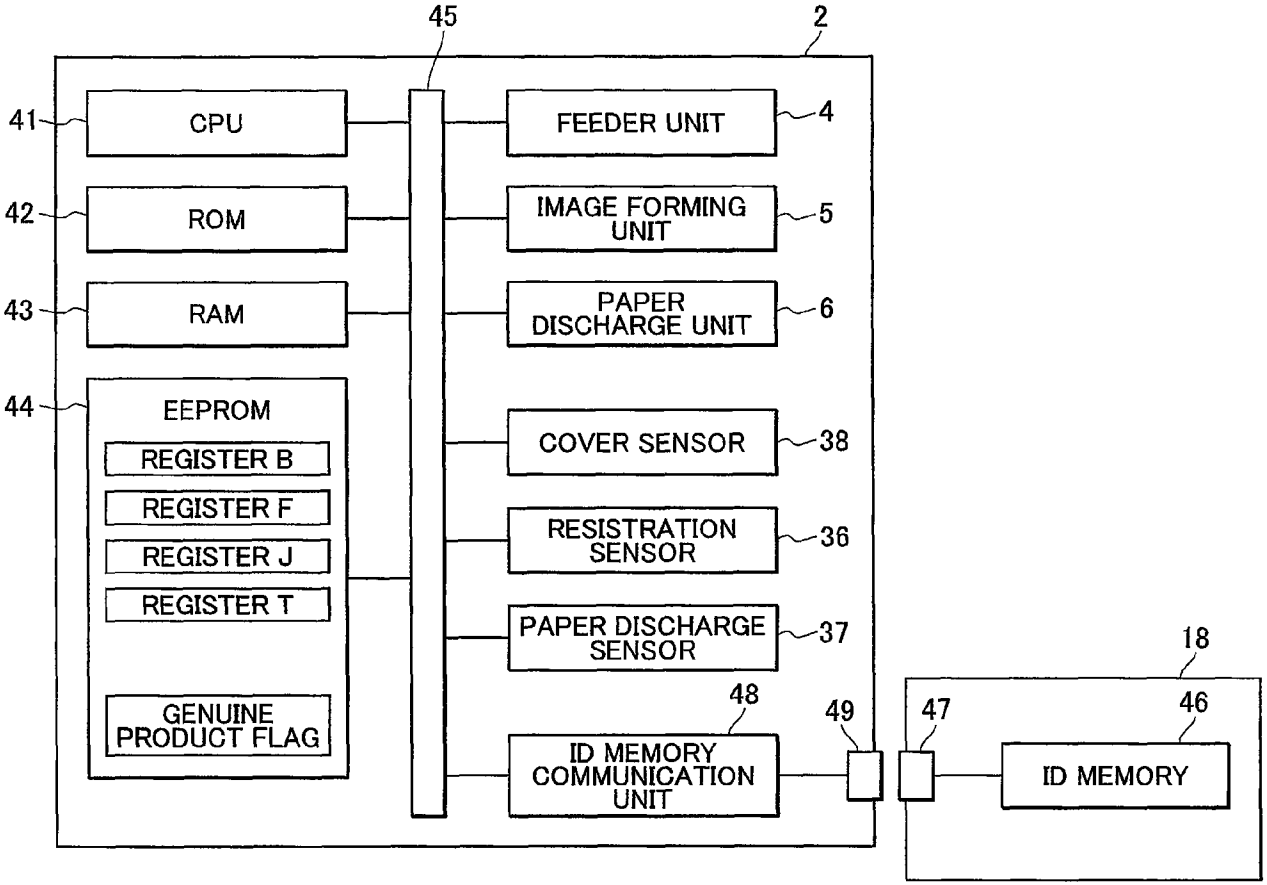
FIG. 2 is a block diagram showing an electrical configuration of the laser printer according to the first embodiment of the present invention.

FIG. 2 is a block diagram showing an electrical configuration of the laser printer 1 according to the first embodiment of the present invention. The laser printer 1 includes a CPU 41, a ROM 42, a RAM 43, and an EEPROM 44. The CPU 41, the ROM 42, the RAM 43, and the EEPROM 44 are connected together through a bus 45, so that data or an address can be transferred between these components.

The ROM 42 stores various programs to be executed by the CPU 41. While the CPU 41 executes a program, the RAM 43 is used as a work area for temporarily storing data and the program. The EEPROM 44 is a rewritable nonvolatile memory. The EEPROM 44 includes a register B, a register F, a register J, a register T, and a genuine product flag. These registers and the flag are used for a usage history recording process described later.

Furthermore, the feeder unit 4, the image forming unit 5, the paper discharge unit 6, the registration sensor 36, the paper discharge sensor 37, and the cover sensor 38 are also connected to the bus 45. The developer cartridge 18, which is mounted in the laser printer 1, includes an ID memory 46 and a cartridge-side connector 47 connected to the ID memory 46. The ID memory 46 stores an ID code that is unique to the developer cartridge 18. The developer cartridge 18 further includes. On the other hand, an ID memory communication unit 48 for communicating with the ID memory 46, and a main casing-side connector 49 connected to the ID memory communication unit 48 are provided in the main casing 2. The ID memory communication unit 48 is connected to the bus 45. When the developer cartridge 18 is mounted in the main casing 2, the cartridge-side connector 47 connects with the main casing-side connector 49. The CPU 41 can read the ID code from the ID memory 46 via the ID memory communication unit 48.

3. Usage History Recording Process

Figure 3:
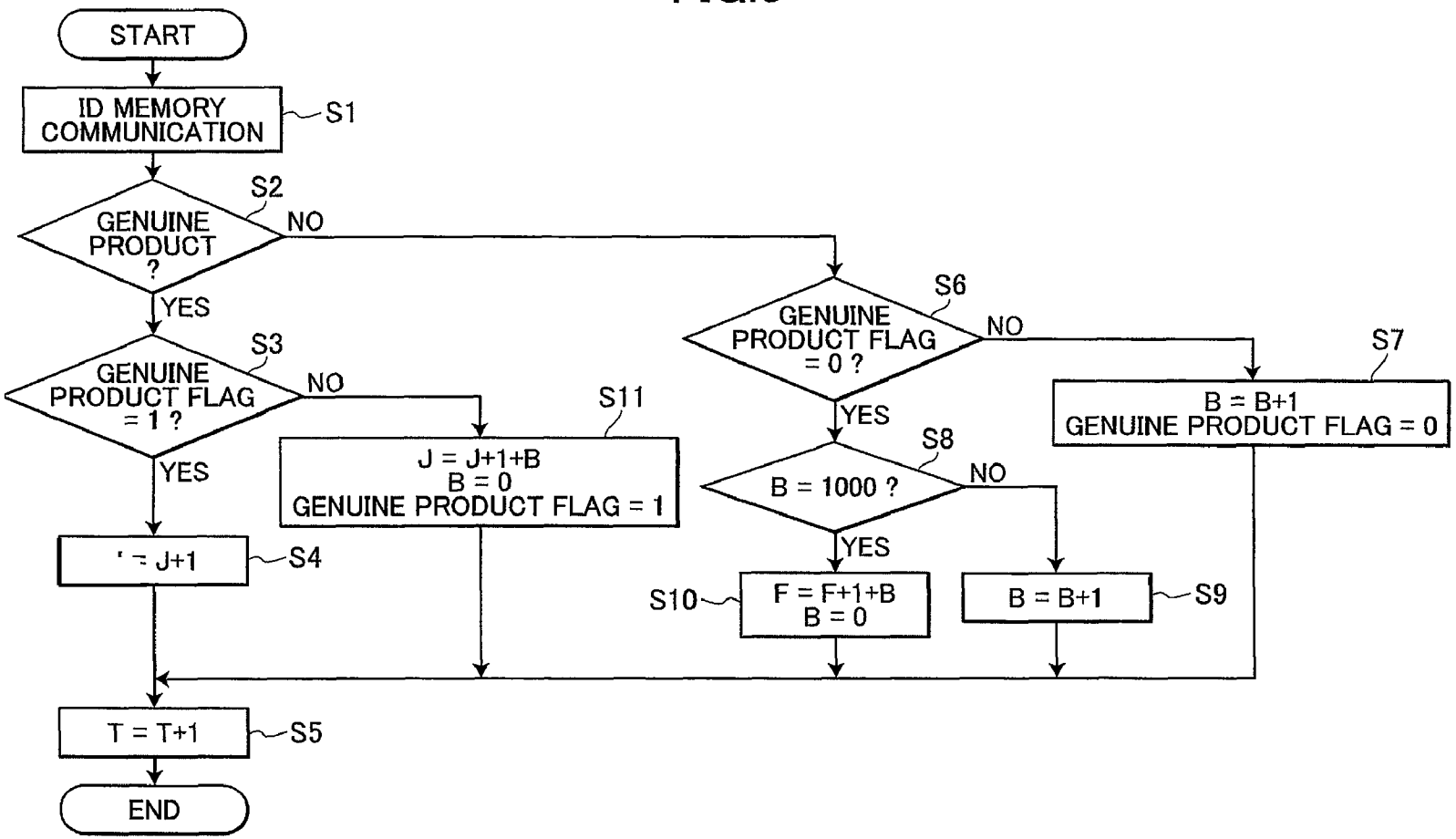
FIG. 3 is a flowchart showing a usage history recording process to be performed by the CPU shown in FIG. 2.

Next, a usage history recording process will be described while referring to FIG. 3. FIG. 3 is a flowchart showing the usage history recording process to be performed by the CPU 41 according to the first embodiment. The usage history recording process is performed, every time the laser printer 1 performs printing operation on a sheet of paper. Specifically, as the laser printer 1 is turned on, a warm-up operation for starting printing operation is performed. Next, the CPU 41 determines whether or not the developer cartridge 18 has been installed in the main casing 2. If the CPU 41 determines that the developer cartridge 18 has not been mounted yet, a display unit (not shown) urges to a user to mount the developer cartridge 18 into the main casing 2. After that, upon receiving image data (character data) to be printed on the paper 3, and a print start command added to the end of the image data received from a personal computer connected to the laser printer 1 or the like, the CPU 41 controls the feeder unit 4, the image forming unit 5, and the paper discharge unit 6, so as to print the image on the paper 3. In addition to this printing operation, the CPU 41 executes the usage history recording process.

In the usage history recording process, first, in S1 the CPU 41 reads out an ID code from the ID memory 46 included in the developer cartridge 18, through the ID memory communication unit 48. Based on the readout ID code, in S2 the CPU 41 determines whether the developer cartridge 18 mounted in the main casing 2 is a genuine product or a non-genuine product. Specifically, the ROM 42 stores a list of ID codes to be given to the genuine product. Therefore, the CPU 41 determines whether or not the list of ID codes has the same ID code as the ID code read from the ID memory 46. If the list of ID codes stored in the ROM 42 has the same ID code as the readout ID code, the CPU 41 determines that the developer cartridge 18 mounted in the main casing 2 is the genuine product.

If the CPU 41 has determined that the mounted developer cartridge 18 is the genuine product (S2: YES), the CPU 41 advances to S3. In S3 the CPU 41 determines whether or not the genuine product flag provided in the EEPROM 44 is set to one. The genuine product flag indicates whether the developer cartridge 18 mounted in the main body casing 2 is the genuine product or the non-genuine product. If the genuine product flag is set to one (genuine product flag=1), the mounted developer cartridge 18 is the genuine product. If the genuine product flag is set to zero (genuine product flag=0), the mounted developer cartridge 18 is the non-genuine product. Note that one is set in the genuine product flag as a factory default setting of the laser printer 1.

If the genuine product flag has been set to one (S3: YES), the CPU 41 advances to S4. In S4 one is added to the value of the register J provided in the EEPROM 44. The register J stores the number of papers 3 on which printing operation has been performed (the cumulative total number of papers 3 consumed by printing operation), provided that the developer cartridge 18 mounted in the main casing 2 is the genuine product.

In S5 one is added to the value of the register T provided in the EEPROM 44, if the genuine product flag has been set to one. After S5, the CPU 41 ends the usage history recording process. The register T stores the total number of papers 3 printed by the laser printer 1. In a state that the ID code is preferably read from the ID memory 46 of the developer cartridge 18, and that the mounted developer cartridge 18 is the genuine product, one is added to each of the values of the registers J and T, as printing operation is performed on a sheet of paper 3. Accordingly, if printing operation is repeated in such a state, the values of the register J and the register T increase one by one, every time printing operation is performed (per one sheet).

On the other hand, if the developer cartridge 18 mounted in the main casing 2 is the non-genuine product, no ID code corresponding to the ID code read from the ID memory 46 of the developer cartridge 18 is stored in the RAM 43. Therefore, the CPU 41 determines that the mounted developer cartridge 18 is the non-genuine product. Furthermore, if the ID code cannot be read correctly from the ID memory 46 of the developer cartridge 18 due to a bad connection between the cartridge-side connector 47 and the main casing-side connector 49, the CPU 41 determines that the mounted developer cartridge 18 is the non-genuine product.

If the CPU 41 has determined that the mounted developer cartridge 18 is the non-genuine product (S2: NO), the CPU 41 advances to S6. In S6 the CPU 41 determines whether or not the genuine product flag provided in the EEPROM 44 is set to zero. If the genuine product flag is set to one (S6: NO), in S7 one is added to the value of the register B provided in the EEPROM 44. Also, in S7 the genuine product flag is set to zero. Next, in S5 one is added to the value of the register T and the CPU 41 ends the usage history recording process. The register B stores the total number of papers 3 printed in a state that the mounted developer cartridge 18 is determined to be the non-genuine product. Note that one is set in the register B as a factory default setting of the laser printer 1.

In another usage history recording process for the next printing operation, the CPU 41 determines again that the mounted developer cartridge 18 is the non-genuine product (S2: NO). In this case, since the genuine product flag has already been set to zero, the determination whether or not the genuine product flag has been set to zero, is affirmed (S6: YES). In this case, in S8 the CPU 41 determines whether or not the value of the register B is equal to a first predetermined value (1000, for example).

If the value of the register B is not equal to the first predetermined value (S8: NO), in S9 one is added to the value of the register B. Next, in S5 one is added to the value of the register T, and the CPU 41 ends the usage history recording process. If the total number of papers 3 printed in a state that the mounted developer cartridge 18 is the non-genuine product, becomes equal to the first predetermined value (S8: YES), in S10 the value of the register F increases up to the value obtained by adding one to the value of the register B. Further, in S10 the value of the register B is reset to zero. The register F stores the total number of papers 3 printed in a state that the mounted developer cartridge 18 is the non-genuine product. Next, in S5 one is added to the value of the register T, and the CPU 41 ends the usage history recording process.

In the case where the connection between the cartridge-side connector 47 and the main casing-side connector 49 is bad, even if the developer cartridge 18 mounted in the main casing 2 is the genuine product, the CPU determines that the mounted developer cartridge 18 is the non-genuine product. Furthermore, if the bad connection is resolved due to vibrations generated by the developer cartridge 18 when performing printing operation, in another usage history recording process for the next printing operation, the CPU 41 determines that the mounted developer cartridge 18 is the genuine product (S2: YES).

If the CPU 41 has determined that the mounted developer cartridge 18 is the genuine product, in S3 the CPU 41 determines whether or not the genuine product flag has been set to one. Since the genuine product flag has been set to zero in the previous usage history recording process, the determination whether or not the genuine product flag has been set to one, is denied (S3: NO). In this case, in S11 the value of the register J increases up to the value obtained by adding one to the value of the register B. Further, in S11 the value of the register B is reset to zero and the genuine product flag is set to one. Next, one is added to the value of the register T (S5), and the CPU 41 ends the usage history recording process.

4. Effects

As described above, in the usage history recording process, the CPU 41 determines whether or not the developer cartridge 18 mounted in the main casing 2 is the genuine product. If printing operation is repeatedly performed in a state that the developer cartridge 18 is determined to be the genuine product, the register J accumulatively stores the number of papers 3 consumed for printing operation (by adding one to the number already stored in the register J). That is, the value of the register J is incremented by one. On the other hand, if printing operation is performed in a state that the mounted developer cartridge 18 is determined to be the non-genuine product, the number of papers 3 consumed for printing operation is not stored directly in the register F, but temporarily stored in the register B. When the value stored in the register B reaches the first predetermined value, the value of the register B (the first predetermined value) is added to the value of the register F. In other words, the number of papers 3 printed in a state that the developer cartridge 18 is determined to be the non-genuine product, is not stored in the register F, before the number of printed papers 3 reaches the first predetermined value.

This configuration prevents the number of printed papers 3 from being stored in the register F, in a state that the mounted developer cartridge 18 is incorrectly determined to be the non-genuine product although the developer cartridge 18 is the genuine product. Specifically, only the cumulative total number of papers 3 printed when the mounted developer cartridge 18 is truly the non-genuine product, can be stored in the register F.

As a result, the usage history (the number of printed papers 3) of when the mounted developer cartridge 18 is the genuine product and the usage history (the number of printed papers 3) of when the mounted developer cartridge 18 is the non-genuine product can be stored correctly in the register J and the register F, respectively. If the developer cartridge 18 which was determined to be the non-genuine product is now redetermined to be the genuine product, as the following printing operation is performed, the value of the register B is added to the value of the register J. Specifically, when the developer cartridge 18 is definitely determined to be the genuine product, the number of papers 3 printed in a state that the developer cartridge 18 has not been determined definitely yet to be the non-genuine product, is added to the value of the register J, as the number of papers 3 printed by using the developer cartridge 18 which is the genuine product. As a result, the usage history of when the mounted developer cartridge 18 is the genuine product can be stored correctly in the register J.

Furthermore, as the value of the register B is added to either the register J or the register F, the value of the register B is reset to zero. This prevents the value of the register B from being stored in the register J and/or the register F redundantly. Therefore, the usage history of when the mounted developer cartridge 18 is the genuine product and the usage history of when the mounted developer cartridge 18 is the non-genuine product can be stored correctly in the register J and the register F, respectively.

5. Second Embodiment

Figure 4:
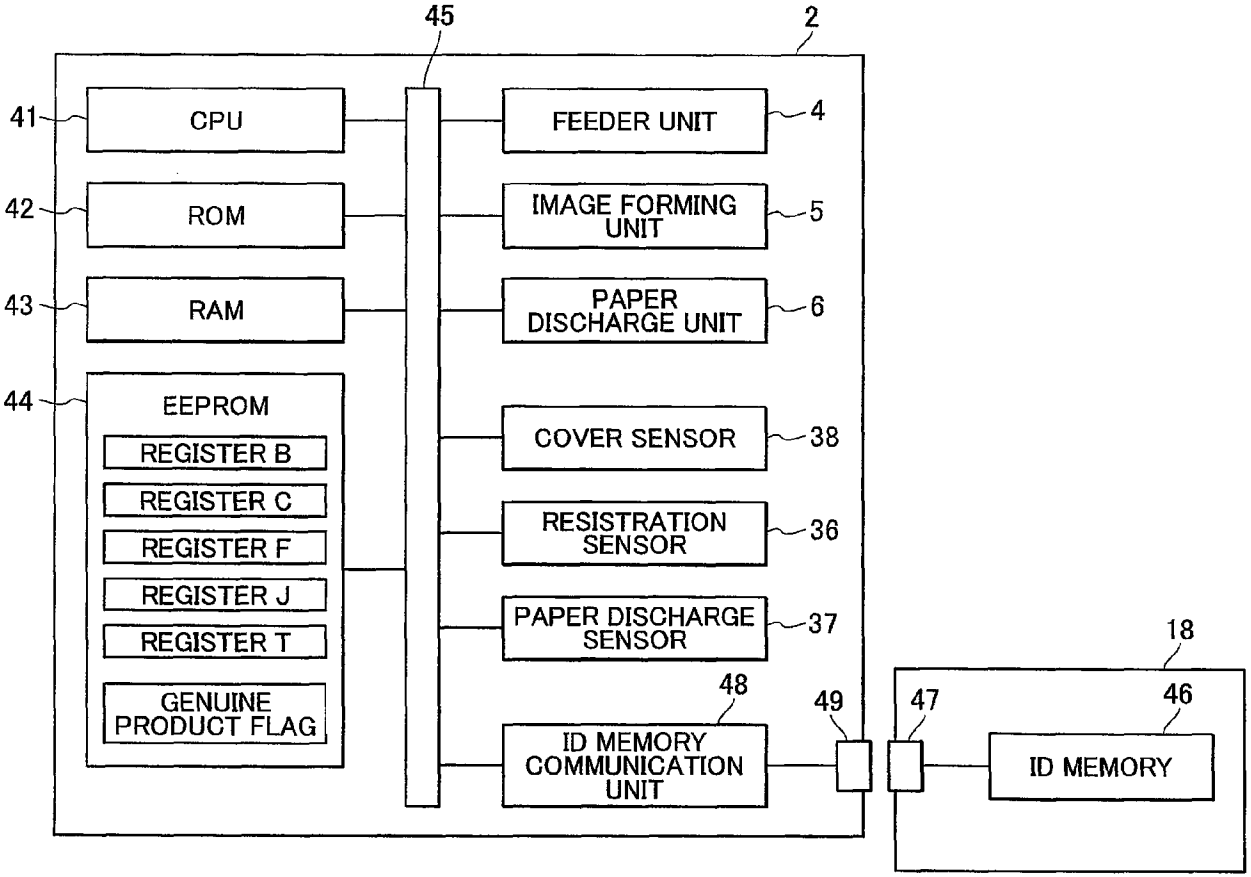
FIG. 4 is a block diagram showing an electrical configuration of a laser printer according to a second embodiment of the present invention.

An image forming device according to a second embodiment of the present invention will be described while referring to FIG. 4. FIG. 4 is a block diagram showing an electrical configuration of a laser printer 101 according to the second embodiment of the present invention. In FIG. 4, parts and components in the structure of the second embodiment that are similar to those in the first embodiment have been designated with the same reference numerals to avoid duplicating description.

Figure 5:
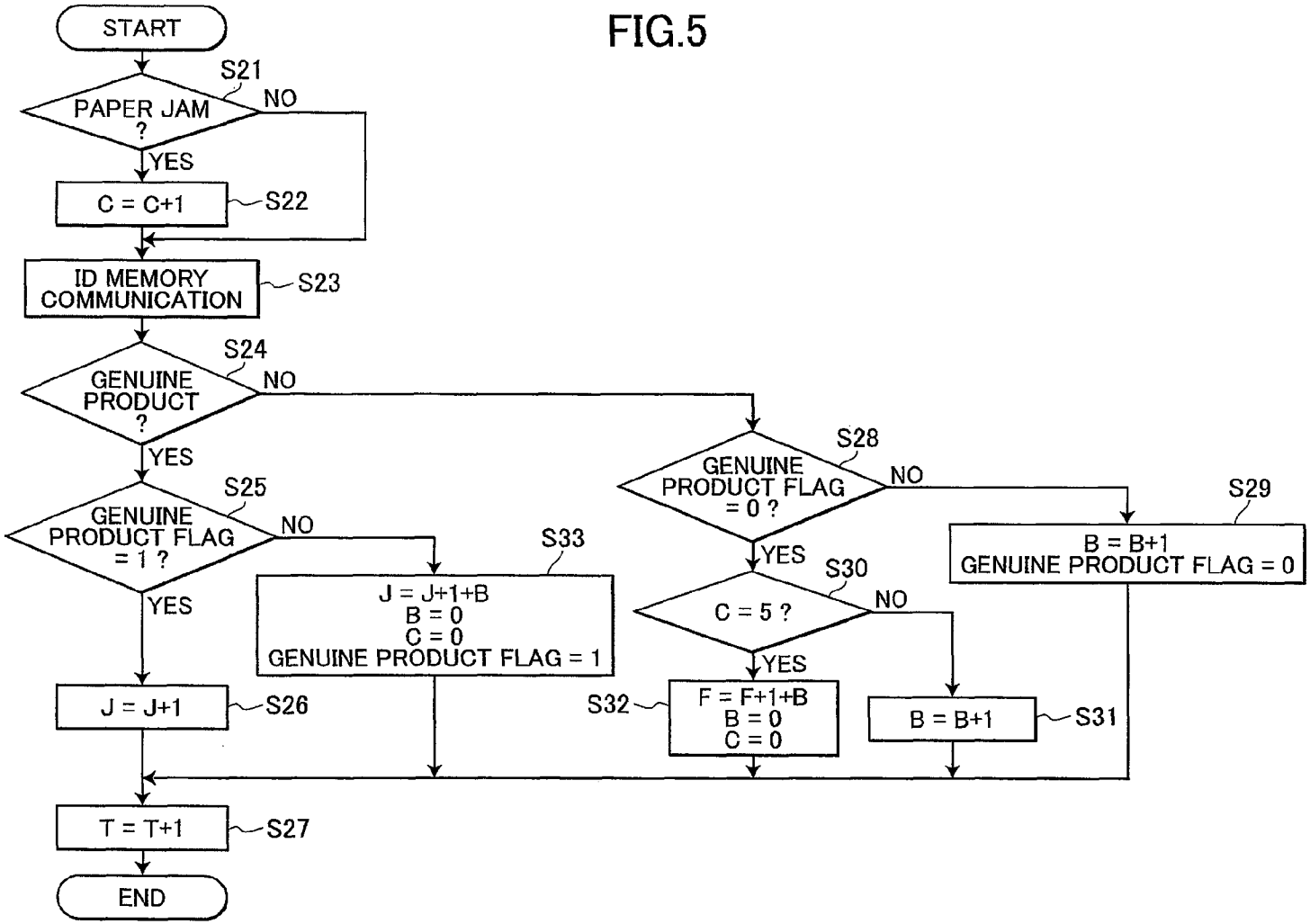
FIG. 5 is a flowchart showing a usage history recording process to be performed by the CPU shown in FIG. 4.

In the second embodiment, the EEPROM 44 includes a register C, in addition to the register B, the register F, the register J, the register T and the genuine product flag. The register C stores the number of paper jams which have occurred in the main casing 2. FIG. 5 is a flowchart showing a usage history recording process to be performed by the CPU 41 shown in FIG. 4 according to the second embodiment.

The usage history recording process is performed every time the laser printer 101 performs printing operation (per one sheet). In the usage history recording process, first, in S21 the CPU 41 determines whether or not a jam has occurred during printing operation. For example, whether or not a jam has occurred is determined based on a time duration after the registration sensor 36 detects the paper 3 until the paper discharge sensor 37 detects the paper 3. Specifically, if the time duration after the resist sensor 36 detects a paper sheet 3 until the paper discharge sensor 37 detects the paper sheet 3, is longer than a predetermined time, the CPU 41 determines that the paper 3 has jammed between the resist sensor 36 and the paper discharge sensor 37. For example, the predetermined time is a time duration slightly longer than the time duration required for feeding the paper 3 from the registration sensor 36 to the paper discharge sensor 37 properly.

If a jam has occurred during printing operation (S21: YES), in S22 one is added to the value of the register C. If no jam has occurred during printing operation (S21: NO), nothing is added to the value of the register C.

Subsequently, in S23 the CPU 41 reads out an ID code from the ID memory 46 included in the developer cartridge 18, through the ID memory communication unit 48. Based on the readout ID code, in S24 the CPU 41 determines whether the developer cartridge 18 mounted in the main casing 2 is the genuine product or the non-genuine product.

If the CPU 41 has determined that the mounted developer cartridge 18 is the genuine product (S24: YES), the CPU 41 advances to S25. In S25 the CPU 41 determines whether or not the genuine product flag provided in the EEPROM 44 is set to one.

If the genuine product flag has been set to one (S25: YES), the CPU 41 advances to S26. In S26 one is added to the value of the register J provided in the EEPROM 44. Subsequently, in S27 one is added to the value of the register T provided in the EEPROM 44, the CPU 41 ends the usage history recording process after S27.

On the other hand, if the CPU 41 has determined that the mounted developer cartridge 18 is the non-genuine product (S24: NO), the CPU 41 advances to S28. In S28 the CPU 41 determines whether or not the genuine product flag provided in the EEPROM 44 is set to zero.

If the genuine product flag is set to one (S28: NO), in S29 one is added to the value of the register B provided in the EEPROM 44. Also, in S29 the genuine product flag is set to zero. Next, in S27 one is added to the value of the register T and the CPU 41 ends the usage history recording process.

In another usage history recording process for the next printing operation, the CPU 41 determines again that the mounted developer cartridge 18 is the non-genuine product (S24: NO). In this case, since the genuine product flag has already been set to zero, the determination whether or not the genuine product flag has been set to zero, is affirmed (S28: YES). In this case, in S30 the CPU 41 determines whether or not a value of the register C is equal to a second predetermined value (5, for example).

If the value of the register C is not equal to the second predetermined value (S30: NO), in S31 one is added to the value of the register C. Next, in S27 one is added to the value of the register T, and the CPU 41 ends the usage history recording process. If the jams have occurred several times in a state that the mounted developer cartridge 18 is the non-genuine product thereby becoming the value of register C equal to the second predetermined value (S30: YES), in S32 the value of the register F increases up to the value obtained by adding one to the value of the register B. Further, in S32 the value of the register B is reset to zero. Next, in S5 one is added to the value of the register T, and the CPU 41 ends the usage history recording process.

In the case where the connection between the cartridge-side connector 47 and the main casing-side connector 49 is bad, even if the developer cartridge 18 mounted in the main casing 2 is the genuine product, the CPU determines that the mounted developer cartridge 18 is the non-genuine product. As the jam has occurred, in order to remove the jamming paper 3, the developer cartridge 18 is detached from and attached to the main casing 2. The bad connection between the cartridge-side connector 47 and the main casing-side connector 49 may be resolved. In this case, in another usage history recording process for the next printing, the CPU 41 determines that the mounted developer cartridge 18 is the genuine product (S24: YES).

If the CPU 41 has determined that the mounted developer cartridge 18 is the genuine product, in S25 the CPU 41 determines whether or not the genuine product flag has been set to one. Since the genuine product flag has been set to zero in the previous usage history recording process, the determination whether or not the genuine product flag has been set to one, is denied (S25: NO). In this case, in S33 the value of the register J increases up to the value obtained by adding one to the value of the register B. Further, in S33 the values of the register B and the register C are reset to zero, and the genuine product flag is set to one. Next, one is added to the value of the register T (S27), and the CPU 41 ends the usage history recording process.

As described above, if printing operation is performed in a state that the mounted developer cartridge 18 is determined to be a non-genuine product, the number of papers 3 consumed for printing operation is not stored directly in the register F, but temporarily stored in the register B. When the number of jams occurred in the main casing 2 reaches the second predetermined value, the accumulative physical value (the number of papers 3) stored in the register B is accumulatively stored in the register F. In other words, the number of papers 3 printed in a state that the developer cartridge 18 is determined to be a non-genuine product, is not stored in the register F, before the number of jam occurrences reaches the second predetermined value.

Also in the second embodiment, the same effects as in the first embodiment shown in FIGS. 2 and 3 can be obtained.

6. Third Embodiment

Figure 6:
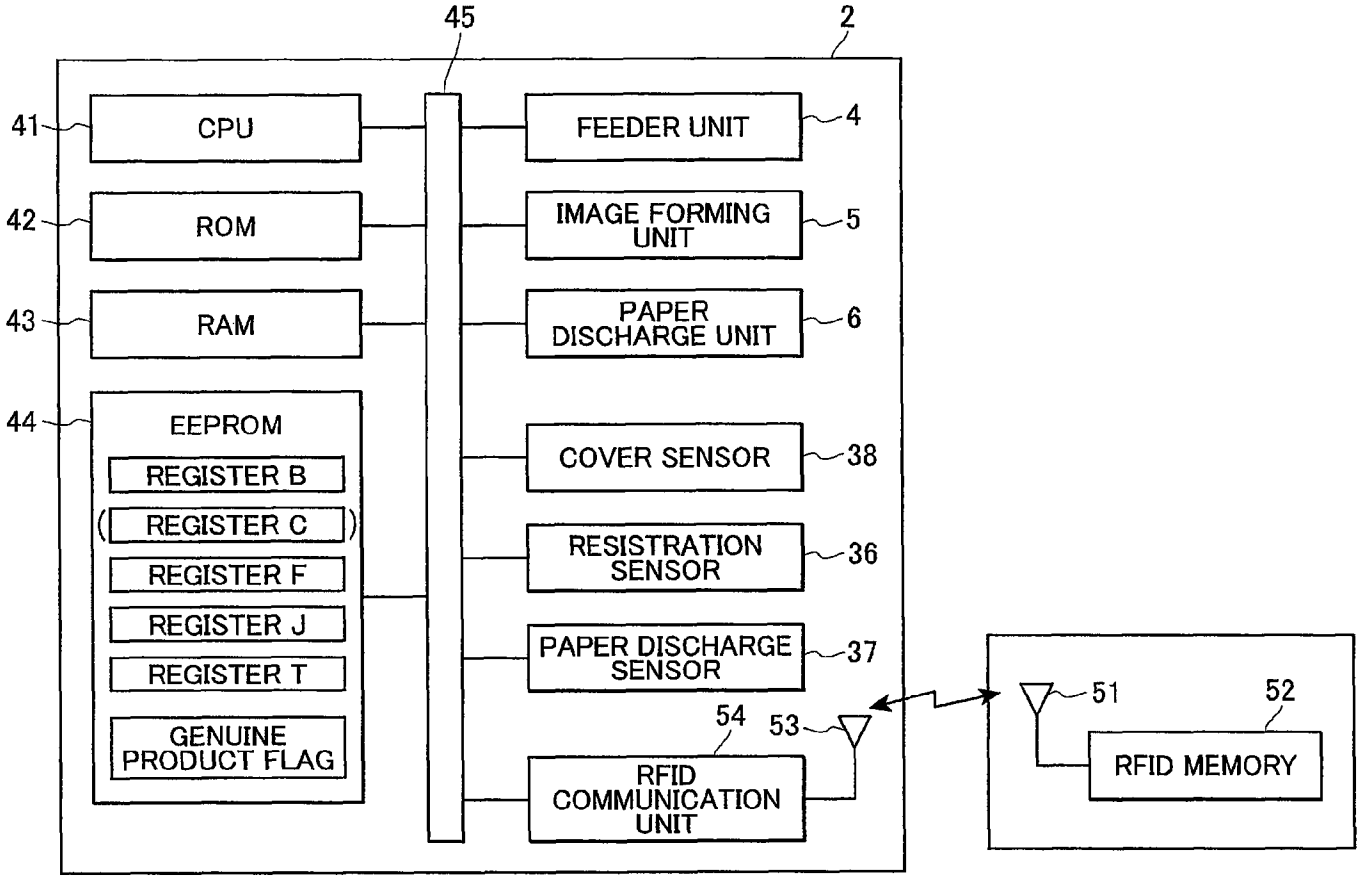
FIG. 6 is a block diagram showing an electrical configuration of a laser printer according to a third embodiment of the present invention.

An image forming device according to a third embodiment of the present invention will be described while referring to FIG. 6. FIG. 6 is a block diagram showing an electrical configuration of a laser printer 201 according to the third embodiment of the present invention. In FIG. 6, parts and components in the structure of the third embodiment that are similar to those in the first and second embodiments have been designated with the same reference numerals to avoid duplicating description.

As shown in FIG. 6, the developer cartridge 18 includes an RFID (Radio Frequency Identification) memory 52 which has an antenna 51, instead of the ID memory 46 and the cartridge-side connector 47, and the main casing 2 includes a RFID communication unit 54 having an antenna 53, instead of the ID memory communication unit 48 and the main casing-side connector 49 shown in FIGS. 2 and 4. The antenna 53 is connected to the bus 45. According to this configuration, as the developer cartridge 18 is mounted in the main casing 2, the CPU 41 can read an ID code stored in the RFID memory 52 via the RFID communication unit 54 by wireless communication.

Since the ID code stored in the RFID memory 52 is read by wireless communication, the ID code are sometimes read incorrectly due to extrinsic noise. Therefore, the usage history recording process described above is particularly effective in the laser printer 201 according to the third embodiment.

Although the present invention has been described with reference to the preferred embodiment, the present invention is not limited to the above embodiment and, evidently, a variety of modifications and changes may be made without departing from the scope of the present invention.

For example, in the above embodiments, the number of papers 3 printed in a state that the mounted developer cartridge 18 is the genuine product, is stored in the register J. The number of papers 3 printed in a state that the mounted developer cartridge 18 is the non-genuine product, is stored in the register F. The usage histories both for genuine and non-genuine products are thus recorded. However, in order to record the usage histories both for genuine and non-genuine products, the physical value increasing with the use of the developer cartridge 18 may be stored both for genuine and non-genuine products, instead of the number of printed papers. Examples of the physical value include the number of times the photoconductive drum 16 has rotated; an amount of consumed toner; the total number of dots which have been used for printing operation; a total data amount which have been used for printing operation; an operating time during which the laser printer 1 (101 and 201) has been operated (a total amount of time during which the power is on); and an operating time during which the motor for rotating the photoconductive drum 16 has been operated.

In the above embodiments, the developer cartridge 18 is employed as a replaceable unit. However, the replaceable unit is not limited to the developer cartridge 18. Any type of replaceable unit is applicable as long as the unit is detachably mounted in the main casing 2. For example, if a process cartridge including the developer cartridge 18 and the processing frame 15 for supporting the photoconductive drum 16 and the like is integrally detachably in the main casing 2, the process cartridge may be employed as a replaceable unit. Furthermore, if a toner box containing toner can be detached from and attached to the main casing 2, in a state that the supply roller 27 and the developing roller 28 are remained in the main casing 2, the toner box may be employed as a replaceable unit.

Figure 7:
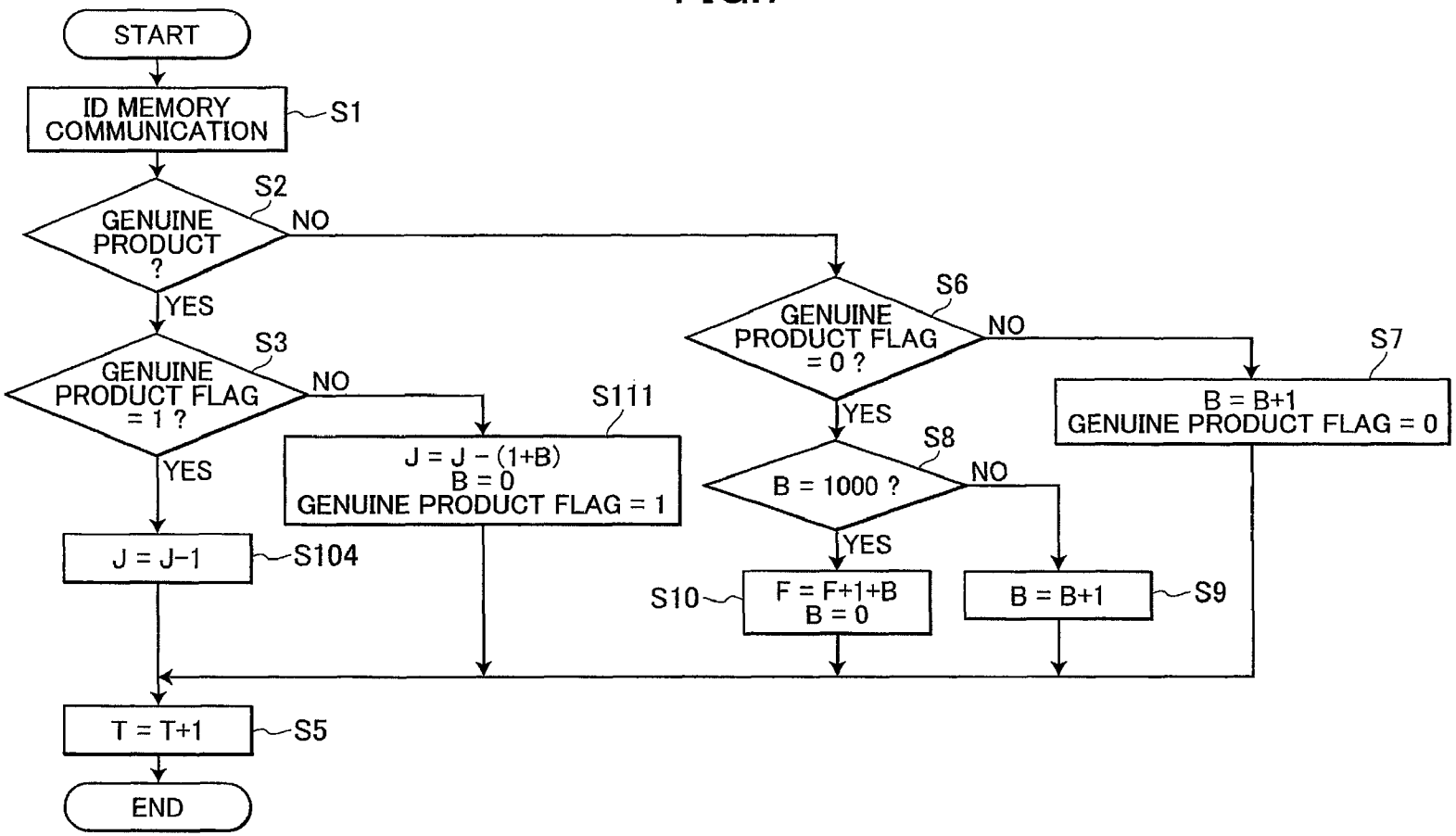
FIGS. 7 and 8 are flowcharts showing a usage history recording process to be performed by the CPU as additional embodiments.
Figure 8:
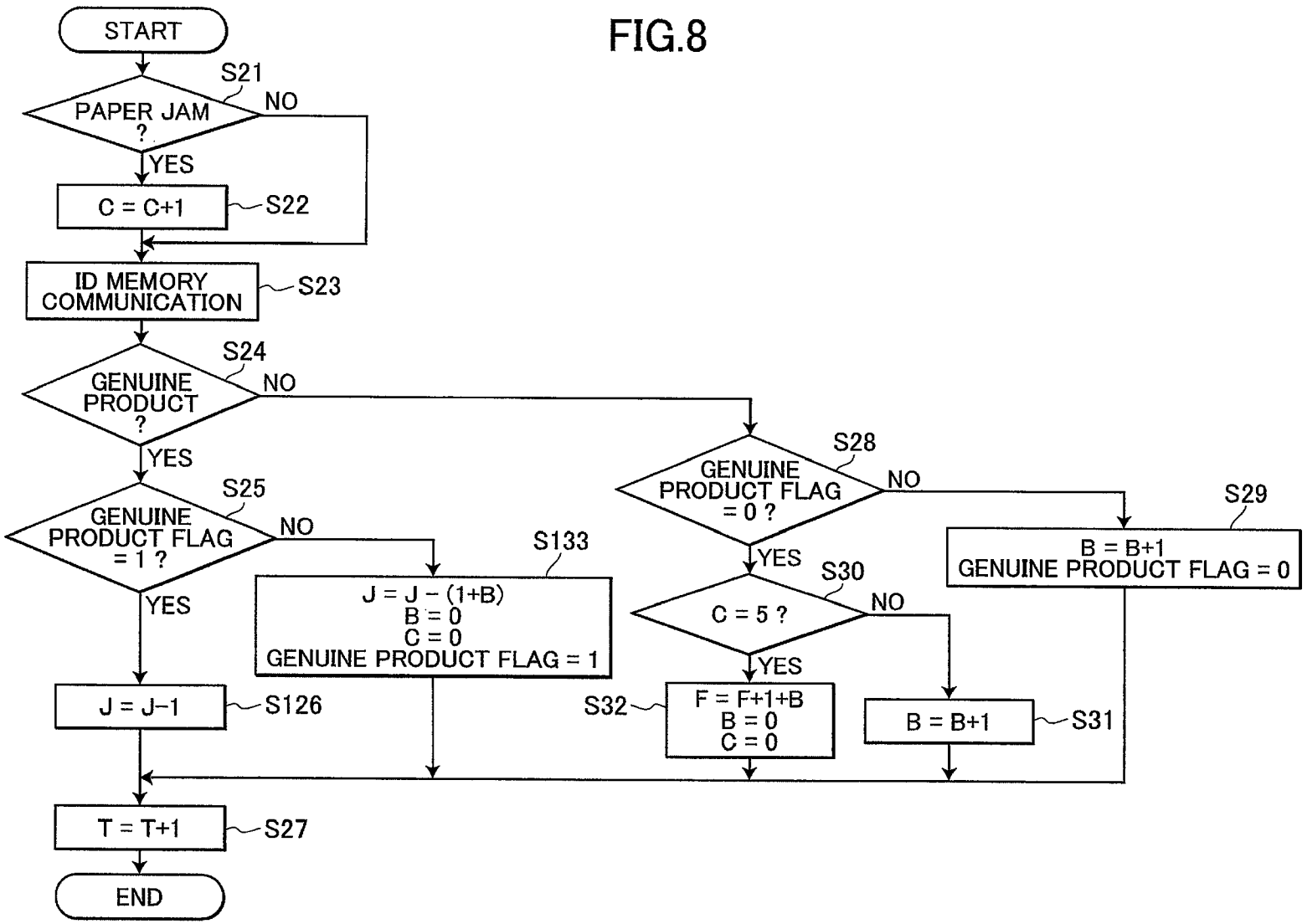

In the above embodiments, in 54 and 26 the value of the register J provided in the EEPROM 44 increase one by one, every time printing operation is performed. As shown in FIGS. 7 and 8, however, ten thousand may be set in the register J as a factory default setting of the laser printer 1, and in S104 and S126 one may be subtracted from the vale of the register J. That is, the value of the register J may decrease one by one, every time printing operation is performed. Note that, ten thousand set in the register J is the number of papers which the developer cartridge 18 which is the genuine product can print. Further, in S11 and S33 one and the value of the register B (1+B) is added to the value of the register J. However, in S111 and 133 one and the value of the register B may be subtracted from the value of the register J.

Although the present invention relates to the monochrome laser printer 1, the present invention is also applicable to a color laser printer.

What is claimed is:

1. An image forming device comprising:

a main body;

a replaceable unit configured to be detachably mounted in the main body;

a processor configured to execute instruction units including:

a determination unit that determines whether the replaceable unit mounted in the main body is a genuine product or a non-genuine product;

a first control unit; and a second control unit;

a first memory mounted in the main body, the first memory being configured to store a physical value changing with a usage of the genuine product in the main body;

a second memory mounted in the main body, the second memory being configured to store the physical value changing with usage of the non-genuine product in the main body;

a temporary memory mounted in the main body, the temporary memory being configured to temporarily store the physical value changing with the usage of the non-genuine product in the main body, wherein the first control unit is configured to count the physical value on the first memory, if the determination unit determines that the replaceable unit mounted in the main body is the genuine product, and wherein the second control unit is configured to count the physical value stored on the temporary memory if the determination unit determines that the replaceable unit mounted in the main body is the non-genuine product, and to store the physical value stored in the temporary memory onto the second memory if the physical value in the temporary memory reaches a predetermined value.

2. The image forming device according to claim 1, wherein the first control unit stores the physical value stored in the temporary memory on the first memory, if the determination unit determines that the replaceable unit is the genuine product.

3. The image forming device according to claim 2, wherein the processor is configured to execute instruction units including:

a first elimination unit that eliminates the physical value from the temporary memory, if the physical value in the temporary memory is stored in the first memory.

4. The image forming device according to claim 1, wherein the processor is configured to execute instruction units including:

a second elimination unit that eliminates the physical value from the temporary memory, if the physical value in the temporary memory is stored in the second memory.

5. The image forming device according to claim 1, wherein the physical value is the number of papers consumed by using the image forming device.

6. The image forming device of claim 1, further comprising:

a third memory mounted in the main body, the third memory being configured to store first data indicating whether the replaceable unit mounted in the main body is the genuine product or the non-genuine product, wherein the processor includes a judging unit that judges, based on the first data, whether the replaceable unit mounted in the main body is the genuine product or the non-genuine product, wherein the determination unit is configured to read second data from the replaceable unit to determine whether the replaceable unit is the genuine product or the non-genuine product, and wherein, if the determination unit determines that the replaceable unit is the genuine product and the judging unit determines that the first data indicates that the replaceable unit is the non-genuine product, the first control unit stores the physical value stored in the temporary memory into the first memory and changes the first data such that the first data indicate that the replaceable unit mounted in the main body is the genuine product.

* * * * *